US012685922B2

(12) United States Patent
Nietvelt

(10) Patent No.: US 12,685,922 B2
(45) Date of Patent: Jul. 21, 2026

(54) DEVICE FOR PROVIDING SETS OF CARDS

(71) Applicant: CARTAMUNDI SERVICES NV, Turnhout (BE)

(72) Inventor: Steven Karel Maria Nietvelt, Turnhout (BE)

(73) Assignee: Cartamundi Services NV, Turnhout (BE)

( * ) Notice: Subject to any disclaimer, the term of this patent is extended or adjusted under 35 U.S.C. 154(b) by 515 days.

(21) Appl. No.: 18/553,363

(22) PCT Filed: Dec. 22, 2022

(86) PCT No.: PCT/EP2022/087402
§ 371 (c)(1),
(2) Date: Sep. 29, 2023

(87) PCT Pub. No.: WO2023/138872
PCT Pub. Date: Jul. 27, 2023

(65) Prior Publication Data

US 2024/0181331 A1 Jun. 6, 2024

(30) Foreign Application Priority Data

Jan. 21, 2022 (EP) ..... 22152602

(51) Int. Cl.
*A63F 1/12* (2006.01)

(52) U.S. Cl.
CPC ..... *A63F 1/12* (2013.01)

(58) Field of Classification Search
CPC ..... A65F 1/12; A65F 1/14
See application file for complete search history.

(56) References Cited

U.S. PATENT DOCUMENTS 12,465,843 B2 * 11/2025 Curley ..... A63F 1/12
2003/0042673 A1 * 3/2003 Grauzer ..... A63F 1/12 273/149 R (Continued)

FOREIGN PATENT DOCUMENTS

EP 2228106 A1 * 9/2010 ..... A63F 1/02
EP 4201495 A1 * 6/2023 ..... A63F 1/14

(Continued)

OTHER PUBLICATIONS

Extended European Search Report from corresponding European Patent Application No. EP22152602.3, Jul. 11, 2022.

(Continued)

*Primary Examiner* — Nicholas J. Weiss
*Assistant Examiner* — Kalyn Gabrielle Younger
(74) *Attorney, Agent, or Firm* — FBT Gibbons LLP

(57) ABSTRACT

A device for providing sets of cards having repurposed cards includes at least a first card handling means comprising a card supply means and a plurality of card storage means. The card handling means includes at least one card grouping means adapted to merge cards from different series of the plurality of series of randomly ordered cards, into a group of cards. A control means is adapted to identify each card of the plurality of series of randomly ordered cards; assign each identified card to one of the plurality of card storage means; and control the card supply means and/or the card grouping means to merge one or more identified cards assigned to the same card storage means, into the group of cards. A group delivering means is adapted to deliver the group of cards in the card grouping means into the card storage means.

15 Claims, 2 Drawing Sheets

(56) References Cited

U.S. PATENT DOCUMENTS

| | | | | |
|---|---|---|---|---|
| 2005/0110210 | A1* | 5/2005 | Soltys | A63F 1/18<br>273/149 P |
| 2006/0145417 | A1* | 7/2006 | Grauzer | A63F 1/14<br>273/148 R |
| 2021/0072018 | A1* | 3/2021 | Krenn | G01B 11/24 |

FOREIGN PATENT DOCUMENTS

| | | | | |
|---|---|---|---|---|
| KR | 20250013275 | A * | 1/2025 | A63F 1/062 |
| WO | WO-2012042823 | A1 * | 4/2012 | A63F 1/06 |
| WO | WO-2023126129 | A1 * | 7/2023 | A63F 1/12 |
| WO | WO-2025012026 | A1 * | 1/2025 | A63F 1/12 |

OTHER PUBLICATIONS

International Search Report from corresponding PCT Application No. PCT/EP2022/087402, Apr. 11, 2023.

* cited by examiner

DEVICE FOR PROVIDING SETS OF CARDS

FIELD OF THE INVENTION

The present invention generally relates to devices for providing sets of cards. In this particular invention, the present invention generally relates to devices for providing sets of cards comprising repurposed cards. The invention further relates to methods to provide sets of cards, more particularly sets of cards comprising repurposed cards.

BACKGROUND OF THE INVENTION

Card games are well known nowadays. Often the game is based upon the unpredictability of the order of cards being dealt or drawn from a randomly ordered deck or set of playing cards, wherein a set of playing cards comprises more than one deck of playing cards being randomly ordered at set level.

As an example, baccarat is played with a randomly ordered set of 8 decks of playing cards, in total 416 randomly ordered cards. For some games, once cards are drawn from the set, the drawn cards cannot be used anymore as such, since the order of drawing and setting aside the drawn cards can be monitored. Often the used playing cards are destroyed. The longer cards are drawn from a set of cards, and because the identity of the cards being drawn from this set can be monitored, the identity of cards still in the remnant of the set may become more predictable, and the chances that one card with a given identity is one of the following cards in the set, increases with each card being drawn. To keep the predictability for the next card being drawn under a given level, the set of cards typically comprises a so-called stop card, which is inserted in or makes part of the set of cards towards the end of the set. Typically, but not necessarily, the stop card is positioned in the last quarter of the set of cards. When this card is drawn from the set, the game is ended immediately or after only a little number of cards being drawn from the set. Sometimes the game is even ended prior to drawing the stop card. As such, a significant number of unused cards remain present in the sets returning from the card playing table. However, the predictability of the identity of cards in this remnant may be significantly high.

Seen the high stakes involved during playing of card games, any possible source of knowledge on or increased predictability of the sequence of cards in the set of cards must be avoided.

A system for creating sets of randomly ordered playing cards is described in WO2012042823. This system comprises a plurality of playing cards collecting means to collect playing cards thereby providing a set of playing cards, originating from a bundle of cards, which may be randomly ordered, a plurality of card stockers for stocking sets of cards being created, and a card sorting device. Cards being identified by their rank and suit, are directed to the first card stocker, as long as this card stocker does not compromise a given number of cards with this rank and suit. If this card stocker does compromise a given number of cards with this rank and suit, the card is directed to the adjacent, second card stocker. This way of directing the cards from the supplied bundle of cards does not alter significantly the predictability of the sequence of cars in the set of cards created, in comparison to the predictability of the sequence of cars in the bundle of cards. Hence using the remnants of the sets of cards from the card playing table having an increased predictability of the sequence of cards, may not lead to newly created sets of cards with a sufficiently low predictability of the sequence of cards.

SUMMARY OF THE INVENTION

Hence their remains a need to provide a method and a device for recuperating the remnants of sets of cards, i.e. the unused cards which remain present in the sets of cards returning from the card playing table.

A device according to the first aspect of the invention, for providing sets of cards comprising repurposed cards, comprises at least a first card handling means comprising a card supply means being adapted to supply a plurality of series of randomly ordered cards, which plurality of series of randomly ordered cards comprises repurposed cards, and a plurality of card storage means, in which the cards of the plurality of series of randomly ordered cards are to be stored, thereby providing sets of cards comprising repurposed cards. The card handling means further comprises at least one card grouping means, in between said card supply means and said card storage means, adapted to merge cards from different series of the plurality of series of randomly ordered cards, into a group of cards. The device further comprises a control means adapted to identify each card of the plurality of series of randomly ordered cards; assign each identified card to one of the plurality of card storage means and control the card supply means and/or the card grouping means to merge one or more identified cards being assigned to the same card storage means, into the group of cards. The device further comprises a group delivering means, adapted to deliver the group of cards in said card grouping means into the card storage means to which the identified cards in said card grouping means are assigned.

So according to the first aspect of the invention, a device for providing sets of cards comprising repurposed cards is provided, the device comprising:

- at least a first card handling means comprising
  - a card supply means being adapted to supply a plurality of series of randomly ordered cards, which plurality of series of randomly ordered cards comprises repurposed cards;
  - at least one card grouping means, adapted to merge cards from different series of the plurality of series of randomly ordered cards, into a group of cards;
- a plurality of card storage means, in which the cards of the plurality of series of randomly ordered cards are to be stored, thereby providing sets of cards comprising repurposed cards, the at least one card grouping means being in between said card supply means and said card storage means,
- a control means adapted to
  - identify each card of the plurality of series of randomly ordered cards;
  - assign each identified card to one of the plurality of card storage means;
  - control the card supply means and/or the at least one card grouping means of said first card handling means, to merge one or more identified cards being assigned to the same card storage means, into the group of cards;
- a group delivering means, adapted to deliver the group of cards in said at least one card grouping means of said first card handling means into the card storage means to which the identified cards in said at least one card grouping means are assigned.

The first card supply means may be adapted to supply 2, 3, 4, 5, 6, 7, 8, 9, 10 or even more series of randomly ordered cards.

According to some embodiments, for the card supply means supplying a plurality of series of randomly ordered cards, more than one of the series of randomly ordered cards may comprise repurposed cards. Optionally all of the series of randomly ordered cards may comprise repurposed cards, or all but one of the series of randomly ordered cards may comprise repurposed cards.

Unless specified differently, the term "card" hereinafter may refer to a playing cards, each card being identifiable by its rank and suit, or may refer to any card which is identifiable by one or more identification elements and/or a card identity code and which form part of a set of cards in which each card comprises such identification elements and/or a card identity code. A set of cards may comprise more than one decks of cards, like decks of playing cards. A deck of cards is a plurality of identical or mutually different cards, which together form one card pack. A deck of playing cards comprises 52 mutually different playing cards, including 13 ranks of 4 suits (hearts, tiles, clovers, and pikes). Each suit includes an ace (depicting a single symbol of its suit), a king, queen, and jack (each depicted with a symbol of their suit) and the ranks two through ten. A set of playing cards may comprise more than one deck of playing cards, like 2, 3, 4, 5, 6, 7, 8, 9, 10, 11 or 12 decks of playing cards, and may further include one or more special cards, i.e. cards with a special function in the game to be played with the set of playing cards, e.g. jokers, stop cards and alike.

The device according to the first aspect of the invention has the advantage that cards from a plurality of sets of randomly ordered cards, including repurposed cards, can be blended and merged into a plurality of new sets of cards, e.g. sets of playing cards, each set comprising more than one decks of playing cards. The sets of cards, e.g. sets of playing cards, are shuffled in random order at set level.

The first card handling means may comprise more than one card grouping means, i.e. a plurality of card grouping means, like 2, 3, 4 or even more card grouping means. Each of the card grouping means may be in between the card supply means of the first card handling means and the card storage means. The one or the plurality of card grouping means are adapted to receive cards from the plurality of series of randomly ordered cards of card supply means.

Each of the plurality of card grouping means of the first card handling means is adapted to merge cards from different series of the plurality of series of randomly ordered cards, into a group of cards. The control means may control the plurality of card grouping means of the first card handling means to merge one or more identified cards being assigned to the same card storage means, into the group of cards.

The use of the card supply means and/or the one or the plurality of card grouping means being controlled by the control means, allows a larger variety of sequences to be generated when defining the position and order of the different cards originating from the plurality of series of randomly ordered cards in the group of cards created at the one or more card grouping means. This leads to an increase in the unpredictability of the sequence and order of cards, after being merged into groups. It thereby guarantees the randomness and unpredictability of the order of cards generated in the final sets of cards in the plurality of card storage means. It allows to use remnants of series of cards, i.e. the unused cards which remain present in the sets of cards, like playing cards, returning from the card playing table, which cards in the remnant may have an increased predictability as far as the sequence of cards in the remnant is concerned.

According to some embodiments, the card supply means may comprise a multiplicity of card supply units, each series of said series of randomly ordered cards is provided by one of the multiplicity of card supply units.

The multiplicity of card supply units may comprise 2, 3, 4, 5, 6 or even more card supply units.

In preferred embodiments, each card supply unit provides one of the plurality of series of randomly ordered cards. The number of card supply units providing a series of randomly ordered cards and the number of the plurality of series of randomly ordered cards is equal. Optionally though, each series of said series of randomly ordered cards is provided by one of the multiplicity of card supply units, one further card supply unit in the multiplicity of card supply units provides cards with known identify. This may e.g. be cards with a special function in a set of playing cards to be created in the card storing means. As an example, this may be so-called "stop cards" present in the set of playing cards used to play baccarat or a similar game.

According to some embodiments, the card supply means may comprise a multiplicity of card supply units, at least one of the multiplicity of card supply units being adapted to provide a series of cards with special function in the set of cards created by the device.

A card with special function may differ from the cards by having no rank nor suit. The card with special function may be identifiable by means of a sign or color or alike, which is visible or detectible at the face-side of the card.

The card supply means may further be adapted to supply one or more than one series of cards with known order and identity.

A series of randomly ordered cards may also be a train of cards, in which the cards are provided flat on a moving belt, the cards being individualized, i.e. one card being separated from the other, so no contact is present between consecutive cards.

According to some embodiments, some and optionally all of the multiplicity of card supply units providing one of the series of said series of randomly ordered card, may comprise a docking station adapted to receive a cartridge comprising randomly ordered cards.

Preferably all of the multiplicity of card supply units providing one of the series of said series of randomly ordered card, comprise a docking station adapted to receive a cartridge comprising randomly ordered cards, such as randomly ordered playing cards.

The cartridges may be cartridges which are used during a card game played at a playing table. When the game is ended, usually a number of cards, like playing cards, remain untouched in the cartridge. These remaining, untouched but already randomly ordered cards may be used to create the series of randomly ordered cards.

This is an advantage, as untouched and unused cards which remain in the cartridges, i.e. the remnant of the series of cards, can be repurposed, recycled, reclaimed and/or reused in newly created sets of cards. This leads to a significant reduction of cards to be disposed, while the reclaimed cards will not be touched by any human during further handling. This again guarantees to a very large extent the certainty of non-fraudulent handling of cards. Seen the high stakes involved in e.g. card playing games, any source of fraudulent playing or behavior must be avoided. Any manipulation of playing cards themselves may be a source of fraud. Therefore even touching cards by human during recycling, reusing or repurposing needs to be limited at maximum or even be avoided.

According to some embodiments, the card supply units may comprise a docking station adapted to receive a cartridge comprising randomly ordered cards, further may comprise a card drawing means adapted to draw cards from the cartridge The cartridge comprising randomly ordered cards may be cartridge comprising randomly ordered playing cards.

The cards may be drawn from the cartridge, being docked in the docking station, one by one and put on a conveyor belt as a series of individualized cards. The card drawing means may be a rotating wheel contacting the surface of the card which is in front of the opening of the cartridge via which cards are normally drawn from the cartridge by the dealer at the playing table. This surface is usually the back-side of the card. The friction between the surface of the card and the rotating wheel is sufficient to move the card downwards and draw in from the cartridge. Alternatively a rotating device is provided, comprising one, two, three, four or even more arms extending radially from a central shaft, the shaft being rotatably mounted around its central axis. The tops or extrema of the arms may touch the surface of the card which is in front of the opening of the cartridge. The friction between the surface of the card and the top of the arm or arms is sufficient to move the card downwards and draw it from the cartridge. The rotating wheel or device may be mount on one of the outer ends of a lever. The second outer end of the lever may be rotationally mounted about a point of rotation, whose rotation axis is parallel with the axis of rotation of the wheel or device. A torsion or similar spring may force the lever to rotate round the axis at the point of rotation, thereby pushing the wheel or device to the surface of the card. The speed of rotation of the wheel or device may be controlled. The rotation of the wheel or device may be driven by a motor, e.g. a speed- or rotation-controlled electronic driven motor.

As a further alternative, a finger may be provided, which top or extremum touches the surface of the card which is in front of the opening of the cartridge, the finger swiping the card which is in front of the opening of the cartridge out of the opening during an oscillation movement. The friction between the surface of the card and the top of the top or extremum of the finger is sufficient to move the card downwards and draw in from the cartridge. The finger may be moved by an eccentric which may be rotatable about an axis. The rotational movement of the eccentric is converted to an about linear movement or oscillation of the top of the finger. The speed of oscillation of the finger or eccentric may be controlled. The rotation of the eccentric may be driven by a motor, e.g. a speed- or rotation-controlled electronic driven motor. The finger may be provided with a suction cup to suck the backside of the card in the cartridge. Alternatively the finger may be the outer limb of a mono- or multi-axis robotic arm. The mono- or multi-axis robotic arm may bring the card sucked and pulled out of the cartridge to a transport means where it is laid on this transport means. The mono- or multi-axis robotic arm may bring the card sucked and pulled out of the cartridge first to a card identification means for identifying the card, prior to providing the card a transport means where it is laid on this transport means.

According to some embodiments, the card supply means may comprise a multitude of transport means, each series of the plurality of series of randomly ordered cards being forwarded to the at least one card grouping means by one of said multitude of transport means.

The multiplicity of transport means may comprise 2, 3, 4, 5, 6 or even more transport means. When the card supply means comprises a multitude of card supply units, each card supply unit may comprise one transport means. Each series of the plurality of series of randomly ordered cards may be forwarded by a transport means. Also after or within the control means, the series of cards with known identify may be forwarded by a transport means to the one or more card grouping means.

Optionally the transport means are adapted to guide the series of randomly ordered cards past or through the control means, for allowing the cards to be identified and optionally checked for suspicious or defective cards. The transport means may comprise several transport means sections cooperating with each other, such that the cards while being transported, can be inspected both at the front side of the card and the back-side of the card. The transport means or one or more of the various transport means sections may be a transport belt by which a card can be carried. The transport belt or one or more of the various transport belt sections may be a transport belt to which a card can be hung. It may be a transport belt or belt section having an outer, lower side provided with non-permanent glue or any type of similar adhesive. Alternatively the transport means or transport means section may be a vacuum belt, air being sucked through the belt and the cards being sucked to the outer, hence lower side of the belt. The transport belt or one or more of the various belt sections may be any belt to which the cards are carried while resting on the belt surface, e.g. in substantially horizontal position. It may be a transport belt or belt section having an outer side provided with non-permanent glue or any type of similar adhesive or having anti-slip properties. Alternatively the transport belt or belt section may be a vacuum belt, air being sucked through the transport belt and the cards being sucked to the outer side of the belt.

The transport belt or one or more of the various belt sections may be continuous belts or bands for transporting material from one place to another. They may be an endless belt or may be a continuous belt provided from a strip of a belt, the 2 ends of this strip being connected one to the other to form a continuous belt, e.g. by thermal welding, by means of staples, or alike.

The transport means or transport means section may alternatively be a transport chain, adapted to move the cards forward from one position to another. As an example, the transport means or transport means section may comprise two mutually parallel profiles, like two I-, U- or L-profiles, which are parallel in their axial or longitudinal direction. The two profiles are spaced and are oriented to each other such that a card can rest on two flanks of mutually parallel profiles, while the side of the card facing the profile flanks is visible between the two profiles. The transport means or transport means section may further comprise a pushing device, like a pushing finger, which pushes the card in the axial or longitudinal direction of the profiles, while the card slides on the flanks upon which it rests.

At the positions where the cards need to be removed or detached from the transport means and/or where the cards need to switch from one transport means section to another, releasing means for releasing the card from the transport means or transport means section may be provided. Such releasing means may be activatable releasing means. An activatable releasing means means that the release means is subjected to controlled activation. The release means may be an interruption means to interrupt the connection of the card to the lower side of the transport means or transport means section and/or a gas blowing means to blow the connected card from the transport means or transport means section. In case gas blowing means are used, the gas blowing means may be an air knife, or a couple of air knives, one of the couple of air knives being mount at each side of the transport means or transport means section, preferably at the same position in longitudinal direction, i.e. the moving direction of the transport means or transport means section.

In case the first card handling means comprises a plurality of card grouping means, a plurality of releasing means for each transport means may be provided, such that the cards may selectively be released and thereby provided to one of plurality of card grouping means. The cards are released at, and received on card receiving positions or points. When the transport means are all substantially parallel one to the other, these and the plurality of card grouping means are all oriented mutually substantially parallel but substantially perpendicular to the transport means, the cart receiving positions or points may be positioned in a matrix-layout, having as much columns as there are series of randomly ordered cards being provided, which may equal the number of card supply units, and rows equal to the number of card grouping means.

According to some embodiments, the control means may comprise a card identifying means identifying cards by their rank and suit and/or one or more identification elements and/or a card identity code.

The card identification means can identify the card by its rank and suit and/or one or more identification elements and/or the card identity, and attribute this information to the position of the card in the sequence of cards from each of the series of the plurality of series of randomly ordered cards passing the card identification means of the control means, e.g. within the stream of cards on the transport means. Each card passing the card identification means may generate a data set comprising the position of the card in the series of the plurality of series of randomly ordered cards and the rank and suit and/or one or more identification elements and/or card identity of this card.

To identify the card, the card identification means may comprise an optical system, e.g. at least one optical system or one optical system per series of randomly ordered cards provided, and optionally comprises one more than one camera per optical system. The images of the face-sides of the cards captured by the camera or cameras, are converted and/or analyzed, such that card identification element or identification elements or identity on the face-side of the cards are identified. These card identification element or elements may be the rank and suit in case of playing cards. Optionally the card identifying means obtains the card identity code which is readable on the face-side of the card, e.g. as a barcode. Optionally the card identifying means may read the card identity code by means of UV light only. The card identifying means thus may comprise a UV sensible camera, and/or may cooperate with a UV lighting device. The card identification means may check for suspicious cards, based upon the card identity code read. For each card identity code read, the card identification means may check if this card with this unique card identity code may be part of the plurality of series of randomly ordered cards, e.g. by comparing the card identity code read with a list of allowed card identity codes stored in a database. If the card with the read card identity code may not be part of the plurality of series of randomly ordered cards, such cards cannot be part of any set of cards generated by the device. The card identification means may identify this card as a suspicious card which needs to be removed from the plurality of series of randomly ordered cards. The card identification means may identify this card as a card to be removed.

The card identification means may identify cards with a special function in the set of cards, like the set of playing cards to be created, like e.g. stop cards. The card identification means may identify this card as a card to be removed, or as a card to be treated as a card which needs to become part of one of the sets of cards being created by the device.

According to some embodiments, the control means may comprise a defect detection means to detect defective cards. The face- and back-side of the cards may be checked for defects, like stains, scratches, tears, dots and alike. Cards with defects cannot be part of any set of cards generated by the device and need to be removed from the plurality of series of randomly ordered cards. The defect detection means may provide information to the card identification means to identify this defective card as a card to be removed.

The defect detection means may comprise one or more optical systems, e.g. one per series of randomly ordered cards, and optionally one or more than one cameras per optical system. The images of the face-sides and the back-sides captured by the camera or cameras, are analyzed, such that defects are identified. Possibly the optical systems, or some of the cameras of the optical systems of the card defect detection mean may be shared with the optical systems of the card identification means.

The identified cards from the plurality of series of cards are assigned to one of the plurality of card storage means by the control means.

The control means may keep track of the number of cards with given rank and suit and/or one or more identification elements having been assigned to each of the card storage means, and will be able to assign a card with an identified rank and suit and/or one or more identification elements to a card storage means, as long as the number of cards with given rank and suit and/or one or more identification elements having been assigned to this card storage means is less than a given threshold value T. As an example, to generate a set of cards consisting of N decks of playing cards and one stop card, for each card with a given rank and suit, this threshold value T will be N, while the threshold value T will be 1 for the stop cards. In this example, T may equal e.g. 6, 8, 10 or 12. As such the control means will be able to generate sets of cards which contain, even consist of a given number of complete decks of cards, shuffled to random at set level.

The control means may continue to assign subsequent cards in each of series of cards to one of the card storage means, until cards for each of the series of cards, the next card cannot be assigned to this given card storage means any longer. The control means may in that case switch to assign subsequent cards in each of series of cards to another of the card storage means. The sequence of switching from one card storage means to another may be a predefined sequence or may be a random choice between the various card storage means.

The control means controls the card supply means and/or the one or more card grouping means to merge one or more identified cards being assigned to the same card storage means, into the group of cards.

According to some embodiments, the device further may comprise a card extraction means, which may be a separate card holding means, or which may be one of the plurality of card storage means. Cards to be removed may be assigned to this card extraction means by the control means.

The control means assigning a cards storage means to an identified card, may add the assigned cards storage means to the data set of this identified card.

According to some embodiments, the control means may keep track of the number of cards with given rank and suit and/or one or more identification elements having been assigned to each of the card storage means.

The control means may keep track of the number of cards with given rank and suit and/or one or more identification elements having been assigned to each of the card storage means, and the sequence in which these cards are provided to the card storage means, the control means may generate a sequence of cards with their rank and suit and/or one or more identification elements, in the order as these cards are provided to each of the card storage means.

The device may comprise a card extraction means adapted to receive cards to be removed from the plurality of series of randomly ordered cards.

According to some embodiments, the device may comprise a card extraction means adapted to receive cards to be removed from the plurality of series of randomly ordered cards, the card extraction means being positioned upstream the at least one card grouping means.

As such, the defective or suspicious cards, or any other special card which needs to be removed from the sets of cards being created by the device, is not to be handled by the one or more card grouping means but may be removed from the series of cards.

According to some embodiments, the at least one, and optionally each, card grouping means comprises a card receiving means on which cards from the plurality of series of randomly ordered cards, which cards are assigned to the same card storage means, are collected.

Such card receiving means may be a chain or transport belt on which the cards are positioned.

The card receiving means comprises a card support, like two parallel but mutually spaced bars or a transport belt or a transport chain. The at least one card grouping means has a delivery point, which delivery point may comprise a card collection basket for receiving a group of cards from the card support. The card delivering means may comprise a pushing means, adapted to push the cards on the card support to the delivery point. This delivery point may comprise a card collection basket to which the cards from the card support are delivered. The group of cards from the card support, optionally pushed into the card collection basket, is thereafter provided into a card storage means. This may be provided by emptying the card collection basket, or by pushing the cards into the card collection basket by the pushing means, pushing the cards via the card delivery point into the card collection basket.

According to some embodiments, the card receiving means may comprise two parallel but mutually spaced bars, the at least one card grouping means having a delivery point, which delivery point comprises a card collection basket for receiving a group of cards from said bars, said bars having two mutually aligned serrated profiles with the flanks having an apex oriented towards the card collection basket which card collection basket is positioned at one end of the bars, for each of the series of the plurality of series of randomly ordered cards, the cards provided to the at least one card grouping means are positioned on one of the flanks of the serrated profiles. As such, the flanks may provide card receiving positions or points.

The apex is also referred to as the top of the serrated profile. A serrated profile is also called a saw-toothed profile. Between two teeth of the serrated profile, a root is present, i.e. the lowest point at the feet of two adjacent teeth of the serrated profile.

According to some embodiments, in the space between the mutually spaced bars, a pushing means from the card grouping means may be slidingly moveable from the bars outer end opposite to the card collection basket towards the end of the bars and towards or beyond the delivery point, at which the card collection basket may be positioned. The pushing means is projecting beyond the root of the profiles. This pushing means may comprise a rod or protrusion, projecting beyond the root of the profiles. In case the first card handling means comprises a plurality of card grouping means, a plurality of pushing means may be provided, one for each card grouping means, each comprising a rod or protrusion, projecting beyond the root of the profiles. Alternatively, one the pushing means may be provided, comprising a plurality of rods or protrusions, projecting beyond the root of the profiles, one for each card grouping means.

Preferably the pushing means is projecting at least halfway between the root and the apex, e.g. beyond the apexes of the profiles.

This pushing means, when moving towards the card collection basket, pushes the cards laying on a flank of the serrated profile, beyond the apex on to the adjacent flank, in the direction of movement of the pushing means. As one or more cards from one or more of the plurality of series of cards are provided to preferably adjacent flanks, the pushing means piles the cards laying on the serrated profile. The cards being on the flank closest to the card collection basket will be at the lower side of the pile of cards, the cards being on the flank farthest away from the card collection basket being at the upper side of the pile of cards. This way, cards from different series of cards are merged into a pile of cards, which pile of cards is pushed towards the card delivery point, and optionally into the card collection basket. The consecutive piles, optionally delivered to the card collection basket, form a group of cards which is delivered to the assigned card storage means. The various consecutive groups together form the set of card in the card storage means.

Optionally, the first card handling means comprised more than one, i.e. a plurality of optionally identical card grouping means. As an example a plurality of identical card grouping means may be provided, each card grouping means having a card receiving means comprises a card support, being two parallel but mutually spaced bars or a transport belt or a transport chain. All pairs of spaced bars or transport belts or transport chains may be parallel one to the other. Each card grouping means has a delivery point, which delivery point may comprise a card collection basket for receiving a group of cards from the card support. The card collection baskets may be linearly aligned, one being adjacent to the other and together forming a row of card collection baskets. The card delivery means means may comprise a pushing means for each card handling means, adapted to push the cards on the respective card support to the respective delivery point. These delivery points may comprise each time the card collection basket to which the cards from the card support are delivered.

The control means may control the card supply means for defining which identified and assigned card is provided to the card receiving means of the at least first card grouping means, e.g. the serrated profile of the bars at which moment. By timing the provision of the cards on the card receiving means and the merging action of the cards into the card collection basket, the control means may control the sequence and order of the cards of the plurality of series of randomly ordered cards in the group of cards being created in the card collection basket. Hence the control means controls the card supply means and/or the at least first card grouping means to merge one or more identified cards being assigned to the same card storage means, into the group of cards. Possibly the timing of the provision of the cards on the card receiving means and the merging action of the cards into the card storage means, optionally via the card collection basket, may be subject of randomness, which randomness is triggered by the control means.

In case a plurality of card grouping means is provided to the first card handling means, the control means may control the card supply means for defining which identified and assigned card is provided to which card receiving means of each of the card grouping means, e.g. the serrated profile of the bars at which moment. Possibly the control means may assign the cards provided to one of the plurality of card grouping means to a different card storage means as compared to the card storage means to which the cards on the other card grouping means are assigned. The control means may for each card grouping means select at random the card storage means to which the cards on the card grouping means are assigned.

By timing, for each of the plurality of card grouping means, the provision of the cards on the card receiving means and the merging action of the cards into the card storage means, optionally via the card collection basket, the control means may control the sequence and order of the cards of the plurality of series of randomly ordered cards in the group of cards being created in the card storage means, optionally via the card collection baskets. Hence the control means controls the card supply means and/or the plurality of card grouping means to merge one or more identified cards being assigned to the same card storage means, into the groups of cards. Possibly the timing of the provision of the cards on the card receiving means and the merging action of the cards into the card storage means, optionally via the card collection basket may be subject of randomness, which randomness is caused by the control means.

Possibly each series of the plurality of series of cards is moved towards the one or more card grouping means by means of a transport means. The control means may temporarily interrupt the movement of each of the transport means to control the provision of card to the card receiving means of the one or the plurality of card grouping means.

Near or at the end of each of these transport means, the card supply means may be provided with an intermediate card storage basket to temporarily hold one or more consecutive cards from the respective series of cards, which cards are all assigned to a given card storage means. These intermediate card storage baskets may be positioned above the card receiving means, e.g. the respective flanks of the serrated profiles. The control means may define the moment of emptying the intermediate card storage basket to the to the card receiving means. Possibly the timing of the provision of emptying the intermediate card storage basket may be subject of randomness, which randomness is caused by the control means. Near or at the end of each of these transport means, the card supply means may be provided with a plurality of intermediate card storage baskets to temporarily hold one or more consecutive cards from the respective series of cards, which cards are all assigned to a given card storage means, while each of the intermediate card storage baskets may be positioned above the card receiving means, e.g. the respective flanks of the serrated profiles of one of the card grouping means.

The control means may define the moment of moving the pushing means, thereby defining the moment of merging the cards to the into the card storage means, optionally via the card collection basket or baskets. Possibly the timing of the moment of merging the cards to the into the card storage means, optionally via the card collection basket or baskets may be subject of randomness, which randomness is triggered by the control means.

By controlling the timing of provision of card to the card receiving means of the one or the plurality of card grouping means, such as by controlling the timing of provision of card to the card storage means, optionally via the card collection baskets and the timing of emptying the intermediate card storage baskets, and the timing of moving the pushing means, the control means has a large degree of freedom to tune or control the order in which the cards being assigned to the same card storage means, are merged into first a pile of cards and by these in the set of cards created in the card storage means. These timings, and the position of the card or cards on the card receiving means, like the position of the card or cards on the serrated profile of the bars, will define the sequence in which the cards are ordered in the set of cards in the card storage means, as well as the order in any intermediate pile of cards or stack of cards. As the control means itself has information on all these timings and positions, the control means has information on the exact sequence of cards in the set of cards created.

As for timings used and controlled by the control means, some or all of the timings may be subjected to randomization. As an example, the moment of moving the pushing means may be subject of a randomization, during the period that there are cards in at least one series of the plurality of series of randomly ordered cards which cards are assigned to the card storage means to which the cards in or on the one or more card grouping means are assigned. Only if no further cards in the plurality of series of randomly ordered cards are assigned to the card storage means to which the cards in or on the one or more card grouping means are assigned, the pushing means is forced to make its movement. This in order to avoid interruption of the activity of the device.

According to some embodiments, the at least one card grouping means may have a delivery point, each of the plurality of card storage means having a card receiving opening, the group delivering means comprises a moving means to position the card receiving opening in front of the delivery point of the at least one card grouping means.

The control means may be adapted to control the delivering means, adapted to deliver the group of cards in the at least one or the plurality of card grouping means into the card storage means to which the identified cards in at least one or the plurality of card grouping means are assigned. The control means may control the movement of the delivering means, such that the card storage means which is to receive a group of cards as formed in one of the card grouping means, is positioned correctly to receive this group of cards as formed in this card grouping means.

Preferably the plurality of card storage means have card receiving openings being aligned linearly or according to a curved path. Preferably the plurality of card storage means having card receiving openings being coplanar. Each time a card grouping means comprises a group of cards to be provided to a given card storage means (because the cards in the group are assigned to this card storage means), the group of cards held by this card grouping means, e.g. the card collection basket, is emptied in the card storage means.

According to some embodiments, the device may comprise M further card handling means, M being an integer equal or more than 1, each of the M further card handling means comprising a card supply means being adapted to supply a plurality of series of randomly ordered cards, which plurality of series of randomly ordered cards comprises repurposed cards;

at least one card grouping means, adapted to merge cards from different series of the plurality of series of randomly ordered cards, into a group of cards;

wherein said group delivering means being adapted to deliver the group of cards in each of the card grouping means of the M further card handling means into the card storage means to which the identified cards in the card grouping means of the M further card handling means are assigned; said control means being adapted to identify each card of the plurality of series of randomly ordered cards from said card supply means of the M further card handling means;

assign each identified card to one of the plurality of card storage means;

control the card supply means and/or the card grouping means of the M further card handling means to merge one or more identified cards being assigned to the same card storage means, into the group of cards in the card grouping means of the M further card handling means.

Preferably, M equals 1, 2 or 3, such that 2, 3 or 4 card handling means are provided.

Possibly, the said control means comprises more than one section control unit, each of the more than one section control units being adapted to identify each card of the plurality of series of randomly ordered cards from the card supply means of one or more of the card handling means;

control the card supply means and/or the card grouping means of one or more of the card handing means to merge one or more identified cards being assigned to the same card storage means, into the group of cards in one or more card grouping means of one or more card handling means.

According to some embodiments, the device may comprise P further card handling means, P being an integer equal or more than 1, each of the P further card handling means comprising a card supply means being adapted to supply a plurality of series of randomly ordered cards, which plurality of series of randomly ordered cards comprises repurposed cards;

at least one card grouping means, adapted to merge cards from different series of the plurality of series of randomly ordered cards, into a group of cards;

wherein said group delivering means being adapted to deliver the group of cards in the card grouping means of the P further card handling means into the card storage means to which the identified cards in the card grouping means of the P further card handling means are assigned; said control means comprises P+1 section control units, each of the P+1 section control units being adapted to identify each card of the plurality of series of randomly ordered cards from the card supply means of one of the P+1 card handling means;

control the card supply means and/or the card grouping means of one of the P+1 card handing means to merge one or more identified cards being assigned to the same card storage means, into the group of cards in one of the P+1 card grouping means of the P further card handling means.

Preferably, P equals 1, 2 or 3, such that 2, 3 or 4 card handing means are provided.

For each of the M or P further card handling means, the card handling means may comprise a plurality of card grouping means.

The M or P further card handling means may all be identical or may mutually differ in the number of card supply units of the card supply means or the number of card grouping means of the card handling means.

The provision of such further card handing means and accompanying card supply means and one or more card grouping means has the advantage that repurposed cards from even a larger number of card sources may be merged and blended into new sets of cards comprising repurposed cards. The device, and in particular its control means, has an even higher degree of freedom to combine and merge cards, such as repurposed cards, from even more different sources into new sets of cards comprising repurposed cards.

According to some embodiments, the device further comprises a card storage voiding means adapted to remove complete sets of cards comprising repurposed cards from the card storage means. The card storage voiding means may make use of a robot or automated system taking and removing the sets of cards comprising repurposed cards from the card storage means.

According to a second aspect of the present invention, a method for providing sets of cards comprising repurposed cards is provided.

The method for providing sets of cards comprising repurposed cards comprises the steps of providing a plurality of series of randomly ordered cards, which plurality of series of randomly ordered cards comprises repurposed cards;

identify each card of the plurality of series of randomly ordered cards;

assign each identified card to one of a plurality of card storage means;

merge the identified cards from different series of the plurality of series of randomly ordered cards being assigned to the same card storage means, into a group of cards;

deliver the group of cards in the card grouping means into the assigned card storage means.

Optionally, the method comprises the steps of providing a device for providing sets of cards comprising repurposed cards according to the first aspect of the present invention.

In the different figures, the same reference signs refer to the same, analogue or similar features.

DETAILED DESCRIPTION OF EMBODIMENT(S)

Figure 1:
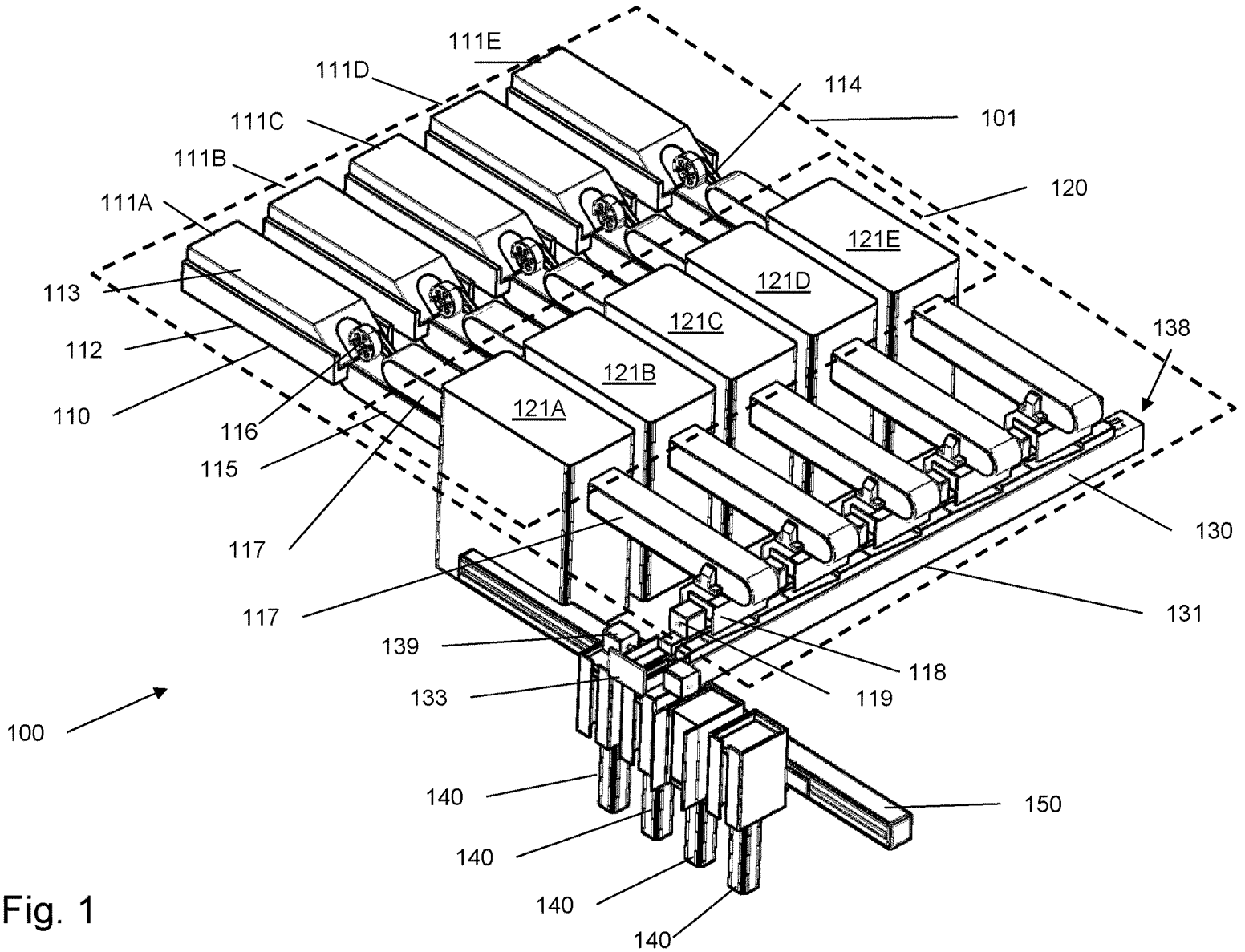
FIG. 1 illustrates schematically a device according to the first aspect of the invention.

A device 100 for providing sets of cards comprising repurposed cards according to the invention is shown in FIG. 1. The device comprises a first, and in this embodiment only one card handling means 101. The one card handling means 101 comprises a card supply means 110 being adapted to supply five series of randomly ordered cards. Optionally, but not shown in the FIG. 1, one of the card supply means 110 is adapted to provide a series of cards with special function in the sets of cards created by the device.

This card supply means 110 comprises Q, Q being an integer larger than one, in this case Q being five, identical card supply units (111A, 111B, 111C, 111D and 111E). It is understood that alternatively, this card supply means 110 may comprise more than five card supply units, e.g. 10 card supply units. Each card supply unit provides one of the five series of randomly ordered cards. Each of the provided five series of randomly ordered cards comprises repurposed cards. Each card supply unit 111A, 111B, 111C, 111D and 111E comprises a docking station 112 adapted to receive a cartridge 113 comprising randomly ordered cards.

The cartridges 113 are cartridges which were used during a card game played at a playing table. A number of cards were kept untouched while being randomly ordered in the cartridge at the end of the game. The cards in the cartridge are drawn from the cartridge 113 one by one card by a drawing means 114 and are put on a first transport means, being a transport belt section 115, as a series of individualized cards, more particularly as a train of cards. The drawing means 114 draws the cards using a rotating wheel 116 contacting the surface of the card which is in front of the opening of the cartridge via which cards can be drawn from the cartridge 113. Alternative drawing means like rotating arms or a swiping finger may be used instead. The drawn cards are resting on the transport belt 115 with their face-side downwards and oriented to the surface of the transport belt 115. Optionally, but not shown in the FIG. 1, one of the card supply units 111A. 111B, 111C, 111D and 111E is adapted to provide a series of cards with special function in the sets of cards created by the device. It would in this case not necessarily comprise a docking station for receiving a cartridge, but it would have a card supply unit adapted to provide the special cards one by one on the first transport belt section, forming a series of cards with special function in the sets of cards created by the device.

A second transport belt section 117, together with the first transport belt section, form a transport mean, like a transport belt, which guides the series of cards from the card supply unit 111A, 111B, 111C, 111D and 111E, through the control means 120, to a first card grouping means 130. This second transport belt section 117 may be a vacuum belt, the cards of the series of cards being sucked to the lower outer side of the vacuum belt. As such, the face-side of the cards being transported may become visible for optical systems, e.g. for cameras taking images from this face-side of the cards. It is understood that alternatively other card transportation means may be used instead.

The control means 120 may comprise five optical systems 121A, 121B, 121C, 121D and 121E, each optical system capturing images from at least the face-side of the cards from one series of randomly ordered cards, the series being transported by the vacuum belt section 117 past the optical systems. The optical systems 121A, 121B, 121C, 121D and 121E are used by both a card identification means, and a defect detection means being part of the control means 120. Optionally, but not shown in FIG. 1, an optical system, comprising one or more cameras, may be provided upstream of the second transport belt section 117, where this optical system makes images from the back-side of the cards in one or in the plurality of series of cards carried by the transport belt section or sections 115. The defect detection means may use these images to detect defects on the back-side of the cards. Alternatively, a provision to turn or temporarily release the card from the second transport belt section 117 is provided to allow the optical systems of the control means 120 to find defects on the back-side of the cards. The card identification means may recognize the card values (like rank or suit) or/and recognizing a unique serial number (e.g. a card identity code). The card identification means may identify and analyze an identity code on the cards and decide a card to be suspicious, hence, to be removed from the series of cards. As an example, the card identification means may identify a card which cannot be part of any of the series of cards being provided at that moment from the plurality of series of random ordered cards, the card identification means may decide this card to be suspicious. Optionally, but not shown in FIG. 1, card extraction means may be provided along the second transport belt section 117 downstream the control means 120. The control means 120 may direct cards with defects, or suspicious cards or cards which need to be removed from the series of cards, into this card extraction means. This card extraction means may be a card extraction basket under each of the second transport belt sections 117, and a card decoupling means, e.g. working under gravity or an air driven card decoupling means, like an air knife, to blow of the card to be removed from the lower side of the second transport belt sections 117 into the card extraction basket is provided.

Figure 2:
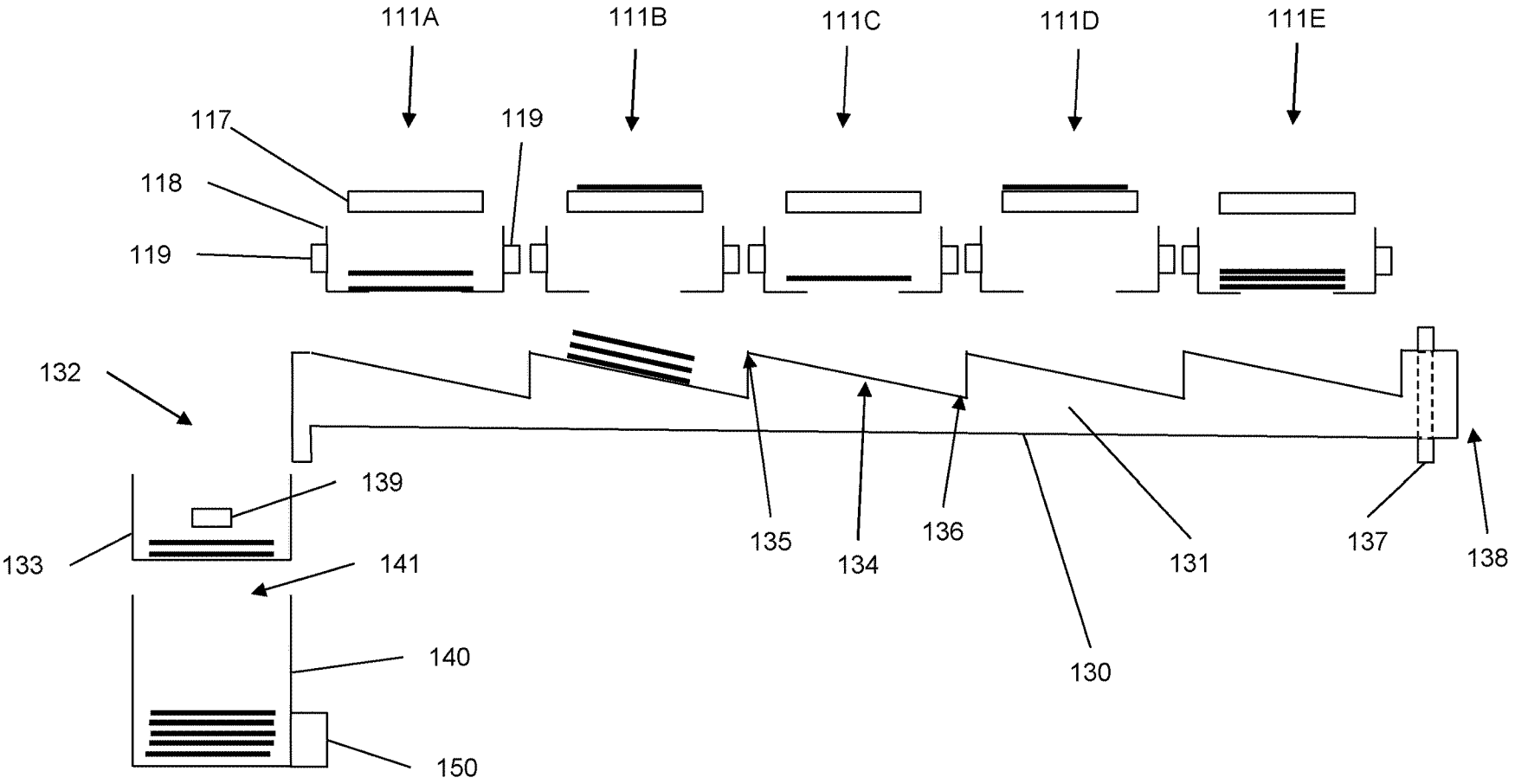
FIG. 2 illustrates schematically a detail of the device according to the first aspect of the invention of FIG. 1.

The cards in the series of cards, once identified, are forwarded towards the card grouping means 130. Between the card grouping means 130 and the end of the second transport belt section 117, an intermediate card storage basket 118 is provided for each series of cards. There is a card decoupling means provide at the end of each second transport belt section 117. A detailed view is provided in FIG. 2. The control means may define at which moment an identified card is to be provided into the intermediate card storage basket 118. The control means may also define at which moment the identified card or cards held in each of the intermediate card storage baskets 118 are released to the card grouping means 130. As an example, activators 119 may be used to open the card storage baskets 118.

The card grouping means 130 is adapted to merge cards from different series of the plurality of series of randomly ordered cards, into a group of cards, stored in the plurality of card storage means 140, in this embodiment four card storage means 140 whose upper open ends 141 are linearly aligned.

The card grouping means 130 comprises two parallel but mutually aligned and spaced bars 131. The card grouping means has a delivery point 132, which delivery point comprises a card collection basket 133 for receiving a group of cards from the bars. The bars have two mutually aligned serrated profiles with the flanks 134 having an apex 135 oriented towards the card collection basket 133 at one end of the bars 131. For each of the series of the plurality of series of randomly ordered cards, the cards provided to the card grouping means are positioned on one of the flanks of the serrated profiles.

Between two teeth of the serrated profile, a root 136 is present, i.e. the lowest point at the feet of two adjacent teeth of the serrated profile.

Between the two bars 131, a pushing means 137 of the group delivering means 150 is slidingly moveable from the bars outer end 138 opposite to the card collection basket towards card collection basket 133. The pushing means 137, e.g. comprising a substantially vertical finger, is projecting beyond the root of the profiles, and in this embodiment even beyond the apexes 135 of the profile of the bars 131.

This pushing means 137, when moving towards the card collection basket 133, pushes the cards laying on a flank 134 of the serrated profile, over the apex onto the adjacent flank, in the direction of movement of the pushing means. As one or more cards from one or more of the plurality of series of cards are provided to preferably adjacent flanks, the pushing means piles the cards laying on the serrated profile. The cards being on the flank closest to the card collection basket will be at the lower side of the pile of cards, the cards being on the flank farthest away from the card collection basket being at the upper side of the pile of cards. This way, cards from different series of cards are merged into a pile of cards, which pile of cards is pushed towards and into the card collection basket 133. The control means 120 assigns the identified cards to a card storage means 140, controls the movement of the second transport belt section 117 and the activators 119, and the movement of the pushing means 137, such that only cards assigned to one and the same of the plurality of card storage means are piled up in the card collection basket 133 as a group of cards.

As an alternative, S card grouping means 130 S being an integer more than one, e.g. 2, 3 or 4, may be provided as part of the card handling means 101. The plurality of card grouping means may be provided in parallel. The plurality of card grouping means may all be identical and provided one next to the other in the direction of movement of the second transport belt section 170. The points where the cards are placed on the card grouping means, e.g. formed by flanks of two adjacent serrated profiles, form a matrix-lay out of card receiving positions or points. As such the matrix layout will be a Q×S matrix. For each card grouping means and per card supply unit, an intermediate card storage basket is provided, also one next to the other in the direction of movement of the second transport belt section and provided above the pairs of serrated bars. At the end of each card grouping means, a card collection basket is provided, collecting cards provided on the respective pair of serrated bars and pushed into the card collection basket by a respective pushing means. The card storage means to which the cards on each of the card grouping means are provided, is controlled by the control means 120. The pushing means 137, may comprise Q vertical fingers, projecting beyond the root of the profiles and moving between each pair of the profiles of each card grouping means.

The consecutive piles delivered to the card collection basket 133 form a group of cards which is delivered to the assigned card storage means 140. To release the group of cards in the cards collection basket 133 in the card storage means 140, the activators 139 may be used to open the lower side of the cards collection basket 133.

The various consecutive groups provided to each of the card storage means 140 together form a set of cards in the card storage means 140.

In order to assure that the group of cards formed in the cards collection basket 133 is provided to the correct card storage means to which the cards are assigned, a group delivering means 150 is provided. The group delivering means 150 is adapted to move the open ends 141 of the various card storage means 140 under the cards collection basket 133. As such, the open end 141 of the card storage means 140 to which the cards in the card collection basket 133 are assigned, can be brought under the cards collection basket 133. The activation of the activators 139 cause the group of cards in the card collection basket to fall into the open end 141 of the card storage means 140 to which the cards in the card collection basket 133 are assigned.

The control means 120 hence is adapted to identify each card of the plurality of series of randomly ordered cards and optionally detect defective and/or suspicious cards. The control means further is adapted to assign each identified card to one of the plurality of card storage means and control the card supply means, the card grouping means to merge one or more identified cards being assigned to the same card storage means, and the group delivering means 150 to combine groups of cards into sets of cards in each of the card storage means.

The control means 120 may keep track of the number of cards with given rank and suit and/or one or more identification elements having been assigned to each of the card storage means 140, and may assign a card with an identified rank and suit and/or one or more identification elements to a card storage means, as long as the number of cards with given rank and suit and/or one or more identification elements having been assigned to this card storage means 140 is less than a given threshold value T. As an example, T may be 6, 8, 10 or 12 for any kind of card of a deck of playing cards and may be 1 for e.g. a card with a special function in a set of playing cards, such as a stop card. This may be organized in many ways. As an example, the control means 120 assigns the first card storage means 140 to the cards as provided in the plurality of series of cards, until the subsequent card for each of the series of cards, cannot be assigned any longer to this given card storage means 140. During this time interval, the control means 120 may control the actions of the transport belts 117, the intermediate card storage baskets 118 and their activators 119 and the pushing means 137. This control of actions may be subject to some degree of randomness, in particularly the moment when activators 119 are activated to drop the cards in the intermediate card storage baskets 118 on the bars 131, and when the pushing means 137 is activated. As such, the order of the cards being provided to the cards collection basket 133 are mixed up, and as the cards originate from a plurality of series of cards which on their turn were already randomly ordered, the predictability of the sequence of cards becomes low if not non-existing. In case a plurality of card grouping means are provide, e.g. in parallel, the control means can also decide to drop the card on a parallel card grouping system to increase the randomness.

Also during this time interval, the group delivering means 150 is controlled and possibly activated such that the first card storage means 140 has its open end 141 under the card collection basket 133 of the card grouping means 130. At the end of the time interval, the activators 139 are activated, such that the cards which are merged into the group of cards in the card collection basket 133 are dropped into the first card storage means 140.

This sequence is repeated three times, each time for a time interval, during which the cards are assigned to one of the other card storage means 140. The control means 120 may follow a pre-set order or strategy in selecting the card storage means being assigned (e.g. the adjacent, i.e. second, third and fourth card storage means 140 is selected, after which the cycle repeats from the first card storage means 140 onwards), or may use a random selection, selecting at random the next card storage means to which cards are assigned. By using a random selection of the card storage means to which cards are assigned, the predictability of the sequence of cards is reduced even more.

This sequence of actions continues until one of the card storage means 140 comprises a complete set of cards, which at that moment is to be removed from the filled card storage means 140. Thereafter the sequence and cycle start again and is repeated. This process is only interrupted in the rare case where all of the subsequent cards for each of the series of cards, can no longer be provided to any of the card storage means.

In order to avoid this interruption, it is preferred to use a larger amount of series of randomly ordered cards per card supply means 110. Additionally or alternatively, more than one card supply means and accompanying card grouping means is used. As an example, a second, third and even a fourth card supply means and accompanying card grouping means is used, each of the card supply means and accompanying card grouping means being provided in a quadrant of a 2×2 matrix setting. The delivery points 132 of the two, three or four card grouping means 110 may be linearly aligned one adjacent the other and positioned above the linearly aligned open ends 141 of the card storage means 140.

The device 100, and in particular its control means 120, has an even higher degree of freedom to combine and merge cards, such as repurposed cards, from even more different sources into new sets of cards comprising repurposed cards. Possibly the control means 120 controls all of the plurality of card supply means and accompanying card grouping means, or comprises control sections, each section controlling one set of card supply means and accompanying card grouping means In each case, the control means 120 is able to generate sets of cards which contain, even consist of a given number of complete decks of cards, shuffled to random at set level. As the control means knows which card was sent to the card grouping means when, and known the sequence of activities of the device, the control means may generate a sequence of cards with their rank and suit and/or one or more identification elements, in the order as these cards are provided to each of the card storage means.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A device for providing sets of cards comprising repurposed cards, the device comprising:

at least a first card handling means comprising:

a card supply means being adapted to supply a plurality of series of randomly ordered cards, which plurality of series of randomly ordered cards comprises repurposed cards;

at least one card grouping means, adapted to merge cards from different series of the plurality of series of randomly ordered cards, into a group of cards;

a plurality of card storage means, in which the cards of the plurality of series of randomly ordered cards are to be stored, thereby providing sets of cards comprising repurposed cards, the at least one card grouping means being in between said card supply means and said card storage means, a control means adapted to:

identify each card of the plurality of series of randomly ordered cards;

assign each identified card to one of the plurality of card storage means;

control the card supply means and/or the at least one card grouping means of said first card handling means, to merge one or more identified cards being assigned to the same card storage means, into the group of cards;

a group delivering means, adapted to deliver the group of cards in said at least one card grouping means of said first card handling means into the card storage means to which the identified cards in said at least one card grouping means are assigned.

2. The device according to claim 1, wherein the card supply means comprises a multiplicity of card supply units, each series of said series of randomly ordered cards is provided by one of the multiplicity of card supply units.

3. The device according to claim 2, wherein the card supply means comprises a multiplicity of card supply units, at least one of the multiplicity of card supply units being adapted to provide a series of cards with special function in the set of cards created by the device.

4. The device according to claim 2, wherein some and optionally all of the multiplicity of card supply units providing one of the series of said series of randomly ordered card, comprise a docking station adapted to receive a cartridge comprising randomly ordered cards.

5. The device according to claim 4, wherein the card supply units comprising a docking station adapted to receive a cartridge comprising randomly ordered cards, further comprising a card drawing means adapted to draw cards from the cartridge.

6. The device according to claim 1, wherein the card supply means comprises a multitude of transport means, each series of the plurality of series of randomly ordered cards being forwarded to the at least one card grouping means by one of said multitude of transport means.

7. The device according to claim 1, wherein the control means comprises a card identifying means identifying cards by their rank and suit and/or one or more identification elements and/or a card identity code.

8. The device according to claim 7, wherein the control means keeps track of the number of cards with given rank and suit and/or one or more identification elements having been assigned to each of the card storage means.

9. The device according to claim 1, wherein the device comprises a card extraction means adapted to receive cards to be removed from the plurality of series of randomly ordered cards, the card extraction means being positioned upstream the at least one card grouping means.

10. The device according to claim 1, wherein the at least one card grouping means comprises a card receiving means on which cards from the plurality of series of randomly ordered cards, which cards are assigned to the same card storage means, are collected.

11. The device according to claim 10, wherein the card receiving means comprises two parallel but mutually spaced bars, the at least one card grouping means having a delivery point, which delivery point comprises a card collection basket for receiving a group of cards from said bars, said bars having two mutually aligned serrated profiles with the flanks having an apex oriented towards the card collection basket which card collection basket is positioned at one end of the bars, for each of the series of the plurality of series of randomly ordered cards, the cards provided to the at least one card grouping means are positioned on one of the flanks of the serrated profiles.

12. The device according to claim 11, wherein in the space between the mutually spaced bars, a pushing means is slidingly moveable from the bars outer end opposite to the card collection basket towards the end of the bars at which the card collection basket is positioned, the pushing means is projecting beyond the root of the profiles.

13. The device according to claim 1, wherein the at least one card grouping means having a delivery point, each of the plurality of card storage means having a card receiving opening, the group delivering means comprises a moving means to position the card receiving opening in front of the delivery point of the at least one card grouping means.

14. The device according to claim 1, wherein said device comprises M further card handling means, M being an integer equal or more than 1, each of the M further card handling means comprising:

a card supply means being adapted to supply a plurality of series of randomly ordered cards, which plurality of series of randomly ordered cards comprises repurposed cards;

at least one card grouping means, adapted to merge cards from different series of the plurality of series of randomly ordered cards, into a group of cards;

wherein said group delivering means being adapted to deliver the group of cards in each of the card grouping means of the M further card handling means into the card storage means to which the identified cards in the card grouping means of the M further card handling means are assigned; said control means being adapted to:

identify each card of the plurality of series of randomly ordered cards from said card supply means of the M further card handling means;

assign each identified card to one of the plurality of card storage means;

control the card supply means and/or the card grouping means of the M further card handling means to merge one or more identified cards being assigned to the same card storage means, into the group of cards in the card grouping means of the M further card handling means.

15. The device according to claim 1, wherein said device comprises P further card handling means, P being an integer equal or more than 1, each of the P further card handling means comprising:

a card supply means being adapted to supply a plurality of series of randomly ordered cards, which plurality of series of randomly ordered cards comprises repurposed cards;

at least one card grouping means, adapted to merge cards from different series of the plurality of series of randomly ordered cards, into a group of cards;

wherein said group delivering means being adapted to deliver the group of cards in the card grouping means of the P further card handling means into the card storage means to which the identified cards in the card grouping means of the P further card handling means are assigned; said control means comprises P+1 section control units, each of the P+1 section control units being adapted to:

identify each card of the plurality of series of randomly ordered cards from the card supply means of one of the P+1 card handling means;

control the card supply means and/or the card grouping means of one of the P+1 card handing means to merge one or more identified cards being assigned to the same card storage means, into the group of cards in one of the P+1 card grouping means of the P further card handling means.

* * * * *